US008112970B2

(12) United States Patent
Marco et al.

(10) Patent No.: US 8,112,970 B2
(45) Date of Patent: Feb. 14, 2012

(54) FLEXIBLE CARRIER AND SYSTEM FOR APPLICATION TO A PLURALITY OF CONTAINERS

(75) Inventors: Leslie S. Marco, Westmont, IL (US); Krzysztof P. Biernat, Lancaster, NY (US); David E. Zurawski, Clarence Center, NY (US)

(73) Assignee: Illinois Tool Works Inc., Glenview, IL (US)

( * ) Notice: Subject to any disclaimer, the term of this patent is extended or adjusted under 35 U.S.C. 154(b) by 56 days.

(21) Appl. No.: 12/242,276

(22) Filed: Sep. 30, 2008

(65) Prior Publication Data

US 2009/0090085 A1 Apr. 9, 2009

Related U.S. Application Data

(60) Provisional application No. 61/079,369, filed on Jul. 9, 2008, provisional application No. 60/998,001, filed on Oct. 5, 2007.

(51) Int. Cl.
*B65B 21/00* (2006.01)

(52) U.S. Cl. ..... 53/398; 53/48.3; 53/556; 53/580

(58) Field of Classification Search ..... 53/398, 53/448, 48.1, 48.3, 48.4, 498, 501, 537, 543, 53/556, 398.2, 580, 582
See application file for complete search history.

(56) References Cited

U.S. PATENT DOCUMENTS

| | | | | |
|---|---|---|---|---|
| 1,912,677 | A * | 6/1933 | Williams | 53/300 |
| 3,061,986 | A | 11/1962 | Paps | |
| 3,187,479 | A | 6/1965 | Ganz | |
| 3,509,684 | A | 5/1970 | Hohl et al. | |
| 3,698,151 | A * | 10/1972 | Arneson | 53/398 |
| 3,742,677 | A | 7/1973 | Best | |
| 3,946,535 | A | 3/1976 | Bourgeois et al. | |
| 4,250,682 | A | 2/1981 | Braun | |
| 4,287,699 | A | 9/1981 | Hart | |
| 4,592,466 | A | 6/1986 | Walters et al. | |
| 4,763,462 | A * | 8/1988 | Johnson et al. | 53/448 |
| 4,832,178 | A * | 5/1989 | Anderson et al. | 198/459.1 |
| 5,054,257 | A | 10/1991 | Cunningham et al. | |
| 5,065,565 | A * | 11/1991 | DiFrank | 53/398 |
| 5,070,992 | A * | 12/1991 | Bonkowski | 198/419.1 |
| 5,117,609 | A | 6/1992 | Seymour et al. | |
| 5,383,321 | A * | 1/1995 | Krogman et al. | 53/48.4 |
| 5,542,231 | A | 8/1996 | Ungar et al. | |
| 5,592,804 | A | 1/1997 | Reuteler | |
| 5,671,588 | A * | 9/1997 | Chan et al. | 53/398 |
| 5,693,113 | A * | 12/1997 | Dries et al. | 65/260 |
| 5,791,121 | A * | 8/1998 | Bernier | 53/398 |
| 6,122,893 | A * | 9/2000 | Weaver et al. | 53/48.4 |
| 6,170,225 | B1 * | 1/2001 | Cervantes et al. | 53/48.4 |

(Continued)

FOREIGN PATENT DOCUMENTS

| | | |
|---|---|---|
| EP | 1 077 184 | 2/2001 |

*Primary Examiner* — Paul Durand

(74) *Attorney, Agent, or Firm* — Pauley Petersen & Erickson

(57) ABSTRACT

A flexible carrier for carrying a plurality of containers includes a flexible sheet and a plurality of container receiving apertures formed in the flexible sheet together with a system and method of application including an applicating machine for applying the flexible carrier to a plurality of containers provided from an infeed includes a jaw assembly that reciprocates to apply a generally continuous string of carrier stock onto a quantity of containers.

8 Claims, 10 Drawing Sheets

U.S. PATENT DOCUMENTS 6,588,173 B1 7/2003 Moore et al.
6,698,160 B2 * 3/2004 Peronek et al. ..... 53/317
6,973,760 B2 12/2005 Moore
7,093,408 B2 * 8/2006 Duperray et al. ..... 53/398
7,124,558 B2 * 10/2006 Weaver et al. ..... 53/539
7,775,348 B2 8/2010 Olsen et al.

* cited by examiner

FLEXIBLE CARRIER AND SYSTEM FOR APPLICATION TO A PLURALITY OF CONTAINERS

CROSS REFERENCE TO RELATED APPLICATION

This Application claims the benefit of U.S. Provisional Patent Application Ser. No. 61/079,369, filed 9 Jul. 2008 and U.S. Provisional Patent Application Ser. No. 60/998,001, filed 5 Oct. 2007.

BACKGROUND OF THE INVENTION

1. Field of the Invention

This invention relates to a flexible carrier for carrying a plurality of containers such as bottles or cans and a system for applying the same.

2. Description of Prior Art

Container carriers connect two or more containers into a sturdy unitized package of containers. Carriers are generally planar arrays of rings, sometimes referred to as six-pack carriers, typically formed from a thermoplastic sheet material. Carriers are applied to containers of various sizes and shapes along various points along the sidewall or under the chime of the container.

Conventional carriers are arranged in aligned arrays of longitudinal rows and transverse ranks of container receiving apertures. A common arrangement is two rows of three ranks of longitudinally and transversely aligned container receiving apertures forming six total container receiving apertures and a "six-pack." Other common configurations include two rows of four ranks forming an eight container multipackage and three rows of four ranks forming a twelve container multipackage.

Conventional applicating machines include a circular jaw drum used to apply carriers to individual containers. The conventional jaw drum is typically fixed into position on the applicating machine and fed with a reel or box of a generally continuous container carriers. Such conventional applicating machines typically include an infeed conveyor for supplying a plurality of containers. Additionally, a reel stand is positioned upstream of the jaw drum to supply a reel of carriers to a feed drum and then on to the jaw drum.

The string of carriers are then traditionally applied to the containers and, following application, cut into a desired package configuration. The resulting package is then fed into a turner-diverter that moves and/or rotates the package to a correct position for placement on a pallet or similar shipping unit.

SUMMARY OF THE INVENTION

The present invention is directed to a flexible carrier for containers which includes a flexible sheet and a plurality of container receiving apertures formed in the flexible sheet.

The flexible carrier in accordance with this invention is preferably used in connection with a machine for packaging multiple containers that includes a jaw assembly moveable in a reciprocating fashion to apply a carrier to a group of containers. This manner of applying flexible carriers is different from traditional methods employing a rotating drum.

The applicating machine according to this invention preferably includes one or more of an infeed, a conveyor positioned inline with the infeed, a carrier unwinder providing a generally continuous string of flexible carriers, and a jaw assembly positioned with respect to the conveyor to urge the flexible carrier over the plurality of containers in a reciprocating manner.

According to a preferred embodiment of this invention, the containers in a column are spaced relative to each other to facilitate application of the individual carriers to the desired quantity of containers.

The jaw assembly as described may include a plurality of fingers that engage openings within the flexible carrier to engage the flexible carrier with the plurality of containers. In addition, a cam may be connected with respect to the jaw assembly wherein the cam may be configured to generally follow a profile of each container of the plurality of containers.

To maintain a compact footprint and flexible manufacturing, the carrier unwinder may be connected to the conveyor. Likewise, each of the described components of applicating machine may be included within a single frame to facilitate flexibility and ease of manufacture of unitized packages. Further to this embodiment, a hinge may be connected between the carrier unwinder and the frame and/or applicating machine to permit the carrier unwinder to move between a generally horizontal position and a generally vertical position, thereby permitting ease of replacement of reels of carrier stock.

In addition, the applicating machine may include a container indexer positioned inline with the conveyor to index a desired quantity of containers for the jaw assembly. Further, a set of pneumatic clamps may be positioned with respect to the jaw assembly to grasp the containers as the jaw assembly is raised from the containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
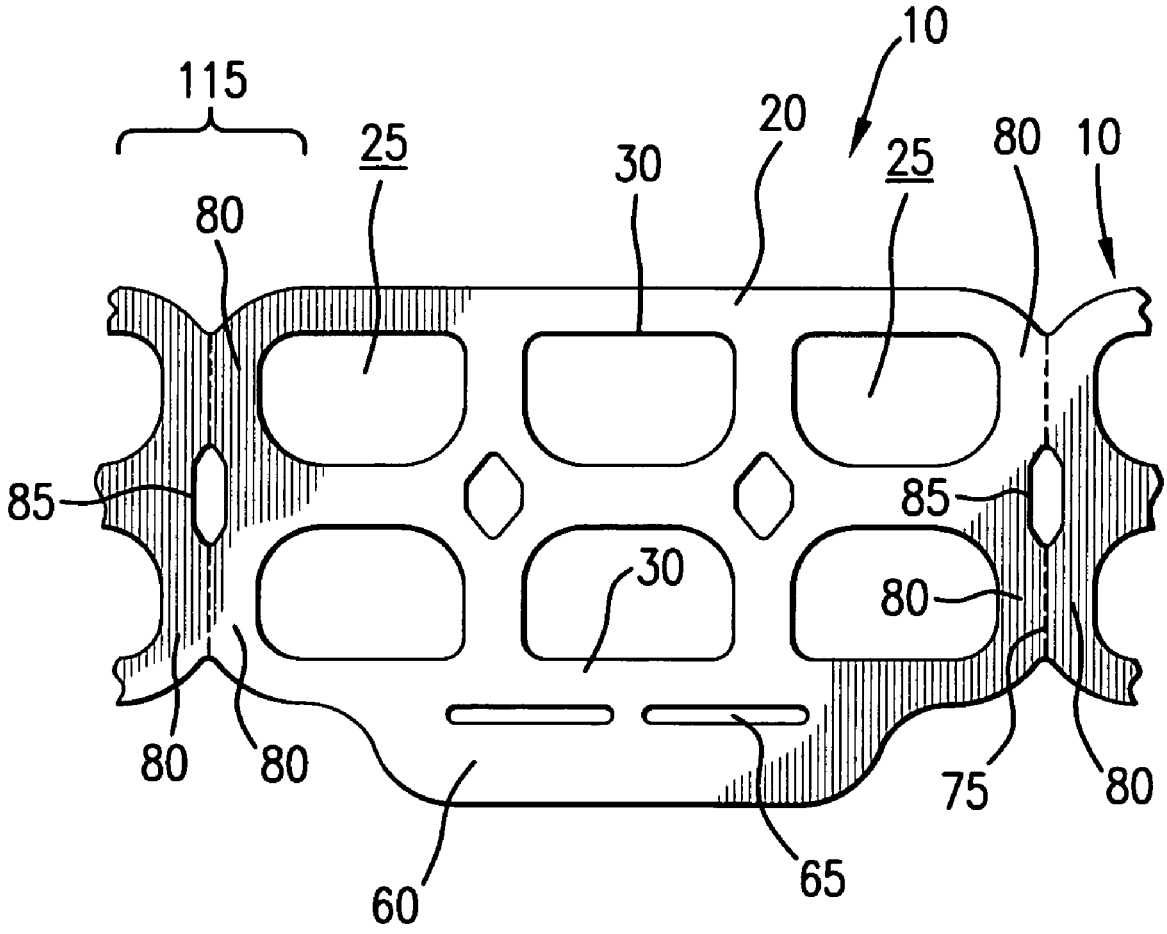
FIG. 1 is a top elevational view of a container carrier according to one preferred embodiment of this invention.

FIGS. 1-4 show various preferred embodiments of flexible carrier 10 and package 15 according to this invention. Flexible carriers 10 generally include a plurality of container receiving apertures 25 that are each stretched around container 50 to form a unitized package 15 of containers 50.

FIG. 1 illustrates flexible carrier 10 according to a preferred embodiment of this invention. As described in more detail below, portions of flexible carrier 10 are stretched a sufficient amount to permit a tight, gripping engagement with containers 50. This tight, gripping engagement also maximizes the amount of material of the flexible carrier 10 positioned in the vertical plane, i.e., in contact with the sidewalls of containers 50.

FIG. 1 illustrates one preferred structure for flexible carrier 10 of the invention. The illustrations are exemplary, and the invention is not limited to the flexible carriers 10 or packages shown. Likewise, the applicating machine described in more detail below may operate in connection with flexible carrier 10 as shown or with variations of such flexible carrier 10. Each flexible carrier 10 preferably includes flexible sheet 20 defining a plurality of container receiving apertures 25, each for receiving a container 50. Flexible sheet 20 includes bands or rings of material, termed container receiving portions 30 herein, that surround each container receiving aperture 25. Such container receiving portions 30 stretchingly engage or grip the respective containers to form a unitized package of containers 50.

As shown in the figures, each flexible carrier 10 according to this invention features an array of container receiving apertures 25. For example, as shown in FIGS. 1-4, the array of container receiving apertures 25 in flexible carrier 10 includes a two rows of three ranks of container receiving apertures 25 totaling six container receiving apertures 25. Other suitable configurations are contemplated by this invention including two rows of two ranks, two rows of four ranks and/or any other desirable configuration of container receiving apertures 25.

Figure 2:
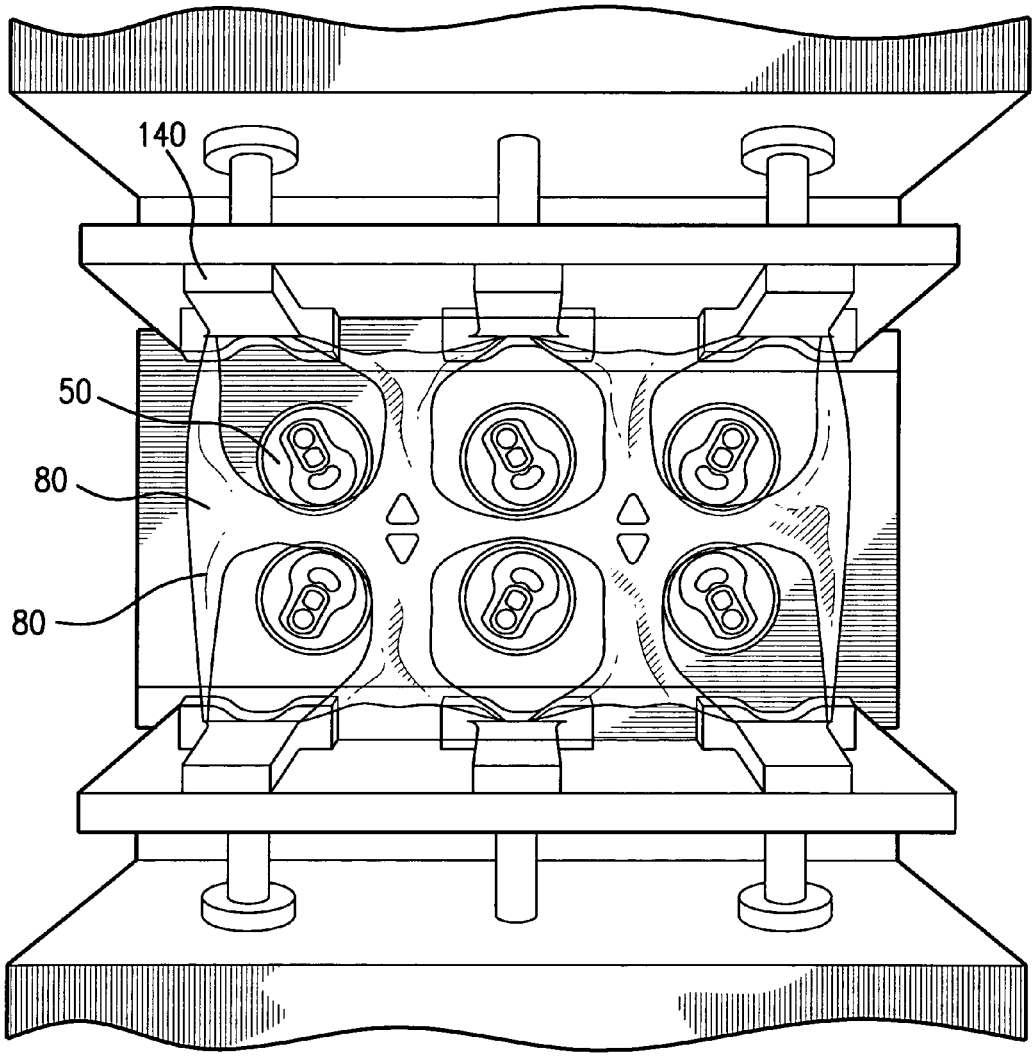
FIG. 2 is a top elevational view of a container carrier and a plurality of containers prior to application according to one preferred embodiment of this invention.
Figure 3:
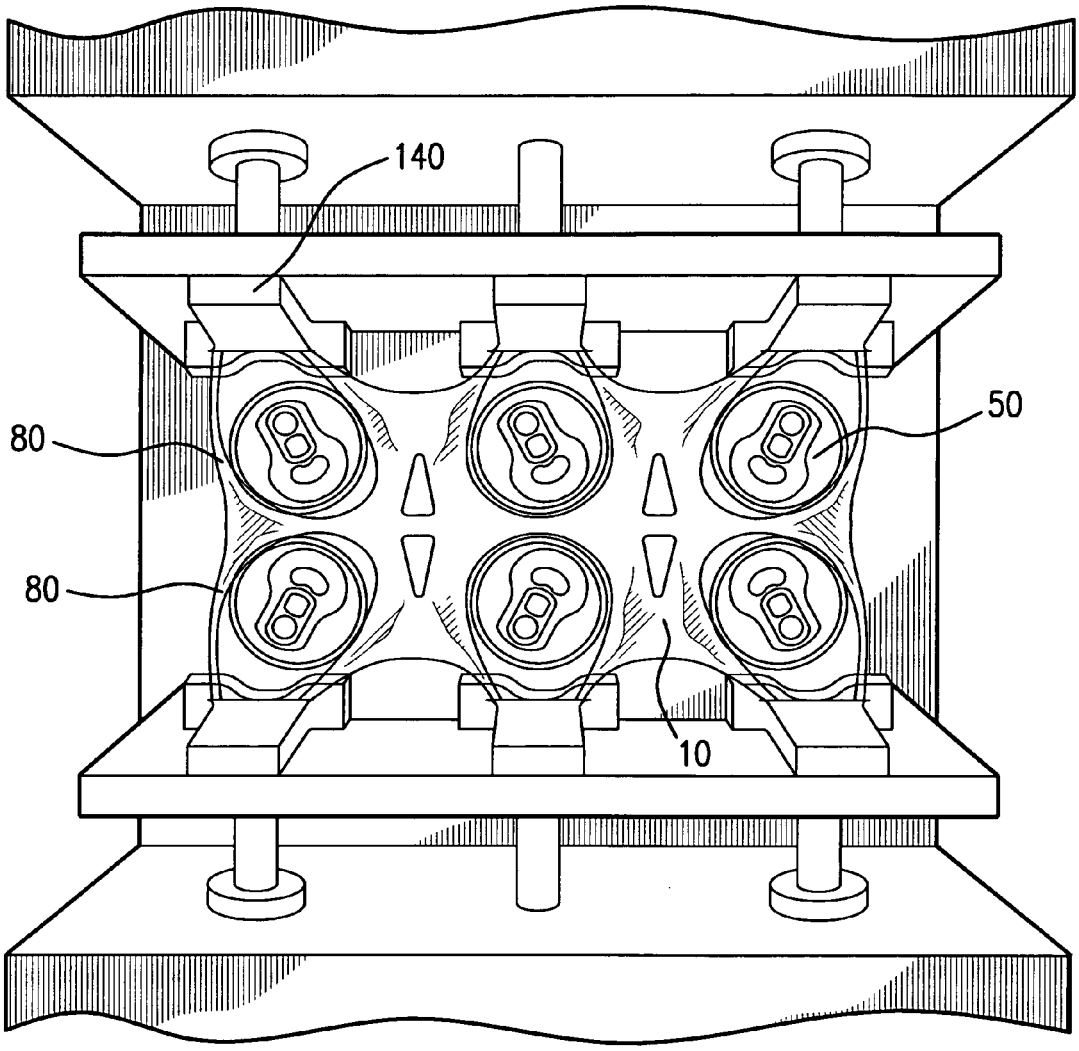
FIG. 3 is a top elevational view of a container carrier and a plurality of containers during application according to one preferred embodiment of this invention.
Figure 4:
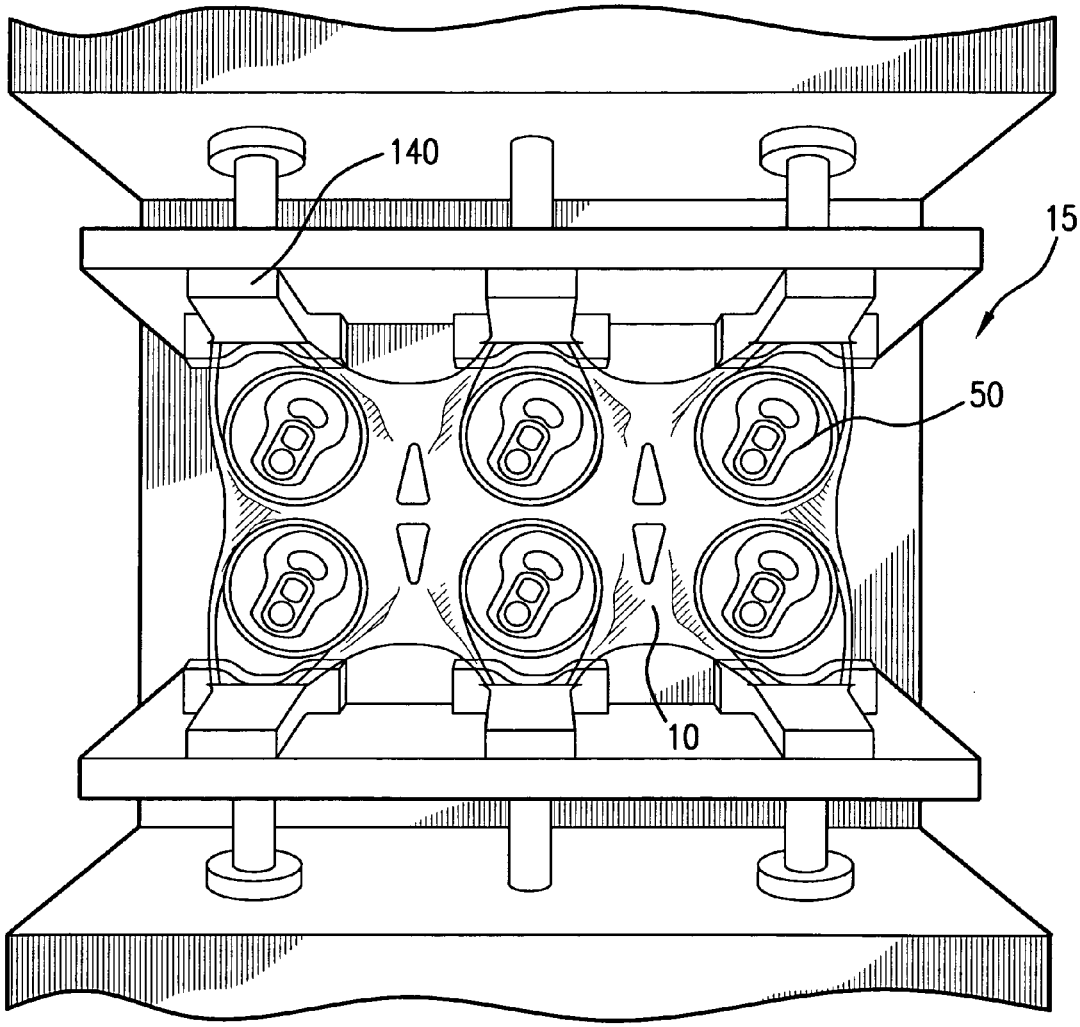
FIG. 4 is a top elevational view of a container carrier and a plurality of containers following application according to one preferred embodiment of this invention.

As shown in FIGS. 2-4, flexible carrier 10 is applied to a plurality of containers 50 to create a package 15 that, following application, includes an aligned array of container receiving apertures whereby each container receiving aperture is aligned longitudinally and transversely with each adjacent container receiving aperture. In the prior art, a container will generally contact a longitudinally adjacent container (within the same row) and a transversely adjacent container (within the same rank). However, as described in more detail below, according to a preferred embodiment of this invention, and as shown in FIGS. 2-4, immediately prior to application of flexible carrier 10 to the plurality of containers 50, each container 50 in a column of containers 50 is preferably spaced longitudinally from each adjacent container 50.

The containers, such as those shown in packages in FIGS. 2-4, are preferably cans. Although cans are shown in FIGS. 2-4, bottles or any other commonly unitized container may be used with flexible carrier 10 according to this invention. The containers are preferably like-sized within a single flexible carrier 10.

As shown in FIG. 1, flexible carrier 10 may further include an integral handle 60 extending generally upwardly from package 15. According to this embodiment of the invention, one or more handle apertures 65 are positioned between handle 60 and the remainder of flexible sheet 20. Handle aperture 65 both provides a void within which to grasp resulting package and permits a flexible interface between handle 60 and remainder of flexible sheet 20.

Flexible sheet 20 of material is preferably cut, using means known to those skilled in the art, such as a stamping die, to form a plurality of container receiving apertures 25 in flexible sheet 20, such as shown in FIG. 1. Container receiving apertures 25 are preferably formed in a rectangular shape having rounded or radiused corners and extending longitudinally across flexible carrier 10 to sufficiently engage and retain a respective container.

Container receiving apertures 25 preferably extend lengthwise or longitudinally along flexible sheet 20 so that a length of each rectangular container receiving aperture 25 is aligned longitudinally along flexible sheet 20 and a width of each rectangular container receiving aperture 25 is aligned transversely along flexible sheet 20. Flexible sheet 20 may include other configurations of container receiving apertures 25 depending on the size of package and/or the number of containers desired.

Flexible carrier 10 is preferably manufactured so that raw carrier stock includes a generally continuous roll of flexible sheet 20 having a plurality of adjacent flexible carriers 10 that are punched and then wound onto a reel or spool having several thousand flexible carriers 10, each flexible carrier 10 attached to each adjacent flexible carrier 10. Flexible carriers 10 are later applied to containers to form packages and, during such process, are preferably unwound from the reels, stretched over the containers, detached at selected points to separate and then separated from each other to form individual packages.

Specifically, each flexible carrier 10 is attached to each adjacent flexible carrier 10 along a series of perforations 75. According to a preferred embodiment of this invention, end straps 80 along a portion of carrier receiving portions 30 defining container receiving apertures 25 of each adjacent flexible carrier 10 are connected along two sets of perforations 75, each set of perforations separating a respective end strap 80 from an end strap 80 of an adjacent flexible carrier 10. A generally straight edge section 85 separates each set of perforations 75 along each end of flexible carrier 10.

As shown in FIG. 1, perforations 75 are formed between each adjacent flexible carrier 10 such that a cut is formed in a periphery of flexible sheet 20 thus encouraging separation between each adjacent flexible carrier 10. Such a perforation pattern in not feasible in conventional carrier design because the drum style application techniques require that adjacent carriers remain attached with respect to each other up to an including application onto containers 50.

The containers to be inserted in container receiving apertures 25 may be bottles or cans having varying shapes and diameters. Carrier receiving portions 30 are installed around the respective containers while stretched, and are allowed to retract or recover to provide a snug fit around the rib, chime or outside sidewall surface of the respective containers.

The flexible sheet 20 used to form the flexible carrier 10 is desirably a polymeric or plastic sheet, which can be formed by an extrusion process and then cut to form flexible carrier 10. The flexible sheet 20 has a thickness which provides sufficient structural integrity to carry a desired number of containers. For instance, each flexible carrier 10 may be designed to carry four, six, eight or more containers of a desired product having a specific weight, volume, shape and size. For most applications, the flexible sheet 20 may have a thickness of about 3-50 mils, suitably about 5-30 mils, commonly about 10-20 mils.

FIGS. 2-4 show one preferred system and method of engagement of flexible carrier 10 with containers 50. As shown, flexible carrier 10 is preferably engaged with applicating machine 110 and then stretchingly engaged with a plurality of containers 50 to form package 15. Such system, method and apparatus is described in more detail below.

FIGS. 2-14 show a system and machine for packaging multiple containers in a carrier according to one preferred embodiment of this invention. As shown in FIGS. 5-12, carrier stock 115 moves through machine 110, specifically through jaw assembly 140, where it is applied to containers and then separated into individual, unitized packages. Carrier stock 115 may comprise a plurality of flexible carriers 10, as described above, connected end to end. Therefore, the machine 110 for packaging multiple containers according to this invention permits the use of a single machine in combination with a variety of sizes of containers, sizes of packages and configurations of packages. Traditional machines are typically fifteen or more feet long and six or more feet wide, however, the machine as described herein includes a small footprint, particularly beneficial for small bottling operations, such as craft brewers.

Figure 5:
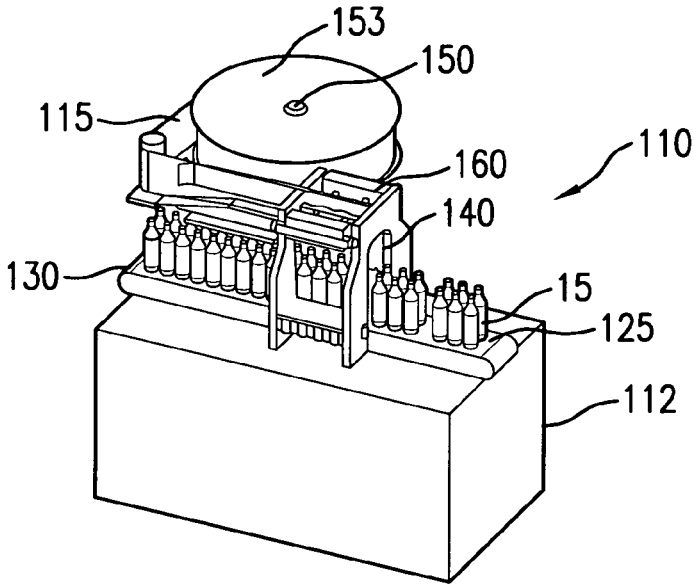
FIG. 5 is a side perspective view of a machine according to one preferred embodiment of this invention.
Figure 6:
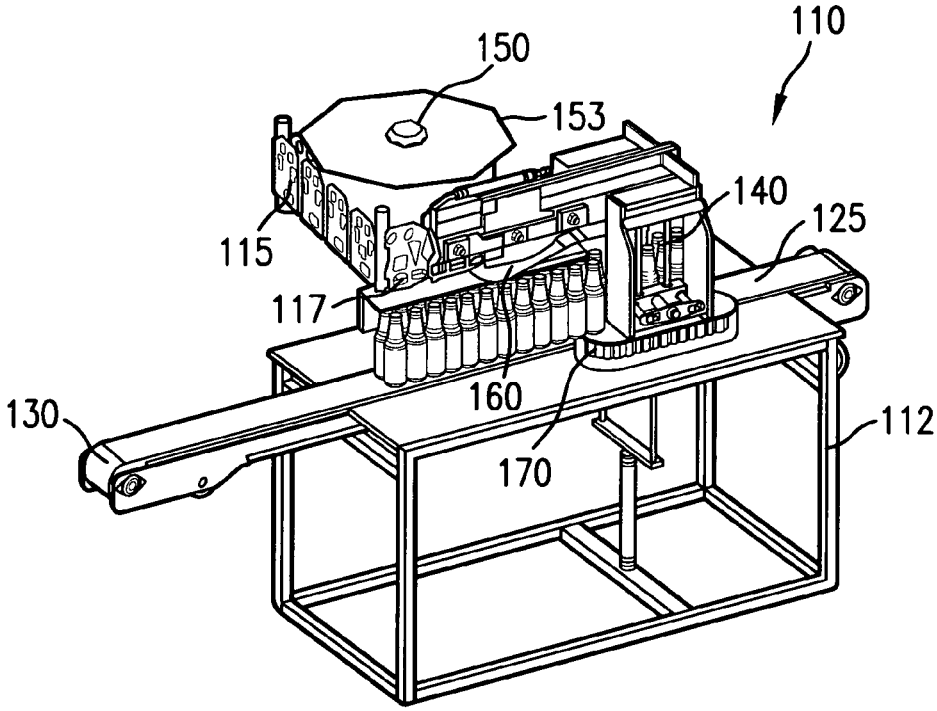
FIG. 6 is a side perspective view of a machine according to one preferred embodiment of this invention.
Figure 7:
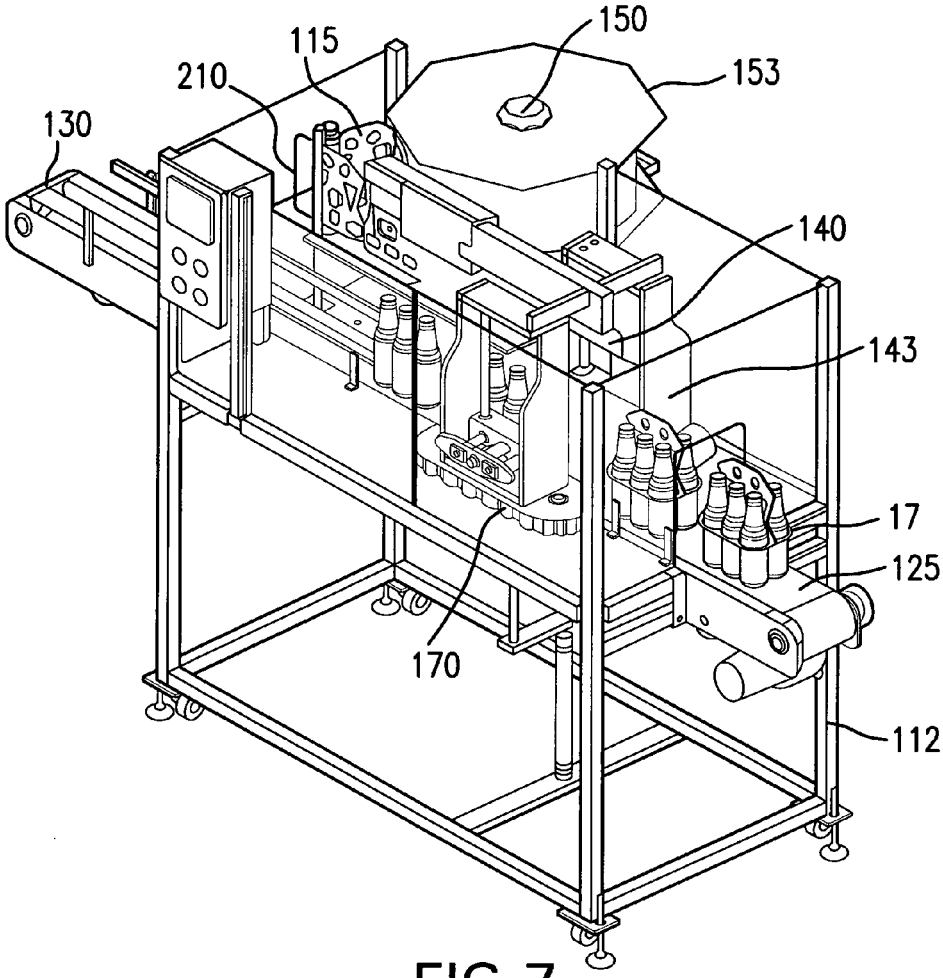
FIG. 7 is front perspective view of a machine according to one preferred embodiment of this invention.
Figure 8:
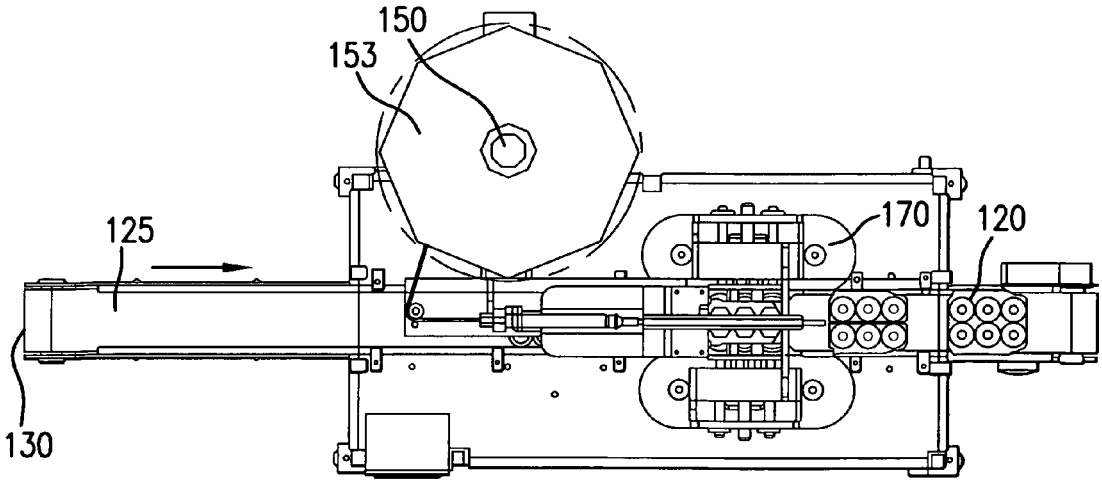
FIG. 8 is a top view of the machine shown in FIG. 7.

FIG. 5 shows applicating machine 110 for applying flexible carrier 10 to a plurality of containers provided from infeed 130. Applicating machine 110 is preferably supported on frame 112 and, according to a preferred embodiment of this invention is generally self-contained on frame 112. As such, applicating machine 110 may be moved in a single step without the requirement that multiple adjacent components be disassembled and reassembled inline.

Infeed 130 preferably accommodates the generally continuous passage of containers into applicating machine 110. For example, according to one preferred embodiment of this invention, conveyor 125 is positioned inline with infeed 130. As used herein, the term "inline" means that the respective jaw assembly is positioned to receive and apply carrier stock 115 to containers. As such, conveyor 125 preferably supplies a preferred column or columns of containers. In a traditional "six pack" arrangement of containers, conveyor 125 preferably provides two generally continuous columns of containers for placement into an appropriate carrier, as described here.

According to a preferred embodiment of this invention, and as shown in FIGS. 2-4, a plurality of spacers 95 are positioned relative to each column of containers 50 positioned in the applicating machine 110. Spacers 95 are preferably positioned to space each container 50 from each adjacent container 50 within a column of containers that are positioned beneath jaw assembly 140 of applicating machine 110.

Carrier stock 115 preferably moves through applicating machine 110 from carrier unwinder 150 where individual, separable carriers are dispersed in a generally continuous string of carrier stock 115 and ultimately to packages 15 where each carrier 10 is separated into a unitized package 15, each package 15 containing a plurality of generally uniform containers 50. As described above, a typical configuration for a package is a six-pack containing two longitudinal rows of containers in three transverse ranks. Additional desired packages such as four-packs, eight packs and twelve packs may be unitized using applicating machine 110 according to this invention, and such additional sizes of packages are limited only by the consumer market for such additional sizes.

One or more operative components of machine 110 are preferably adjustable to permit packaging of containers having different sizes, such as heights and diameters, carriers having different sizes, packages having different sizes, such as six-packs and twelve-packs, and packages having different configurations, namely rim-applied carrier (RAC) configurations and side-applied carrier (SAC) configurations. In each of these different applications, multiple components of machine 110 may be adjusted, replaced and/or interchanged to permit application of carrier stock 115 to containers 50. Several of these components are described in more detail below.

As shown in FIGS. 5-11, carrier unwinder 150 provides a generally continuous string of flexible carriers, such as flexible carrier 10 described above. Carrier unwinder 150 preferably comprises a spindle or similar apparatus to accommodate reel 153 onto which a generally continuous string of container stock 115 is wound. Carrier unwinder 150 is preferably integrated within applicating machine 110, for instance, positioned on or within frame 112 of applicating machine 110 and directly adjacent conveyor 125 and/or infeed 130. As shown in FIG. 5, carrier unwinder 150 may provide a generally continuous string of flexible carriers arranged in a generally vertical orientation.

Carrier unwinder 150 is preferably positioned to accommodate reel 153 of carrier stock 115 in a generally horizontal position. According to a preferred embodiment of the invention, hinge 155 is connected with respect to carrier unwinder 150 to permit carrier unwinder 150 to move between a generally horizontal position and a generally vertical position. Movement between a generally horizontal position and a generally vertical position permits a machine operator to load a new reel 153 of carrier stock 115 onto carrier unwinder 150 following exhaustion of the previous reel 153. As such, carrier unwinder 150 is shifted from a horizontal operating position to a vertical refilling position to permit an operator to easily lift and position reel 153 onto carrier unwinder 150 and then return carrier unwinder to the horizontal operating position using hinge 155.

Figure 9:
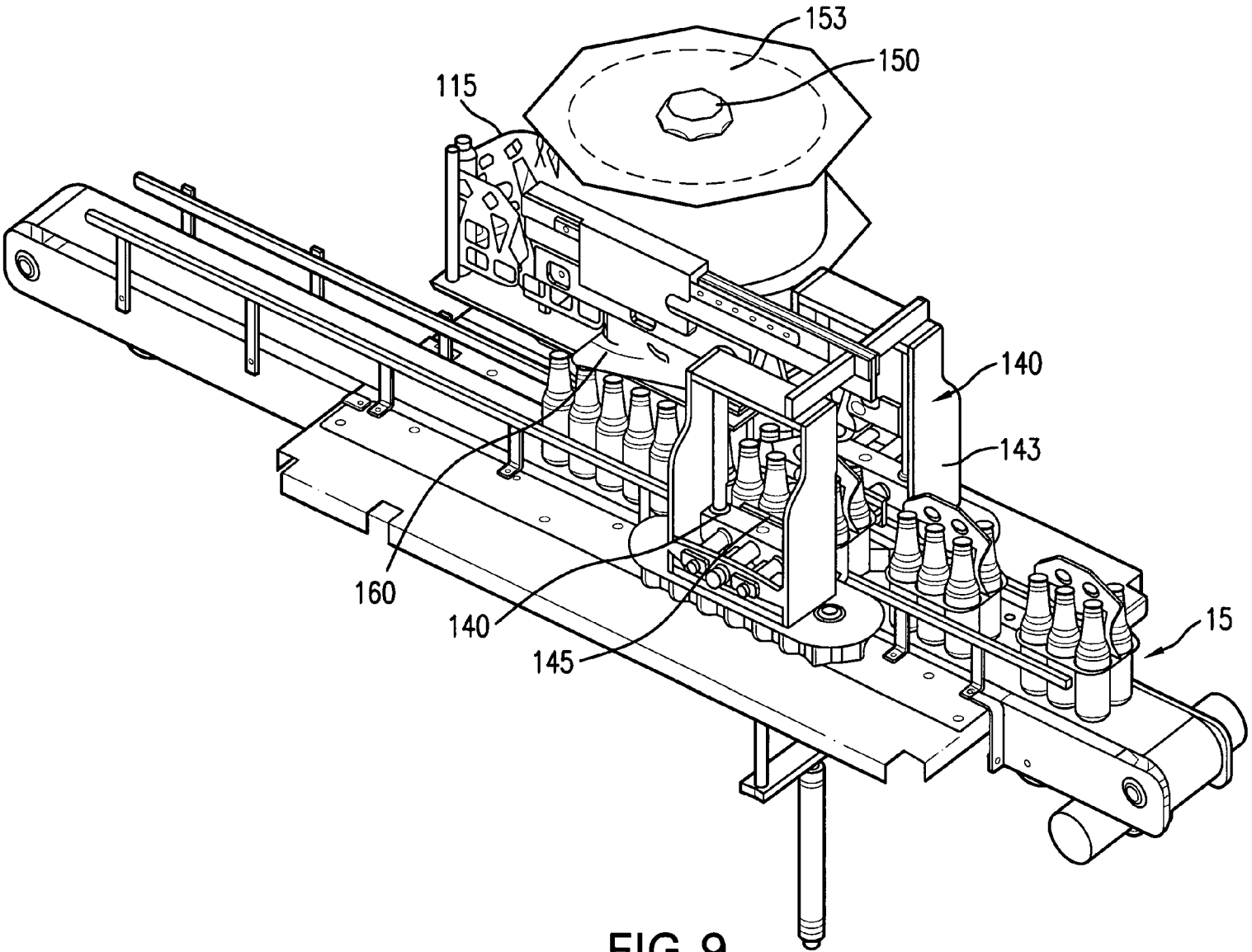
FIG. 9 is a side perspective view of a machine according to one preferred embodiment of this invention.
Figure 11:
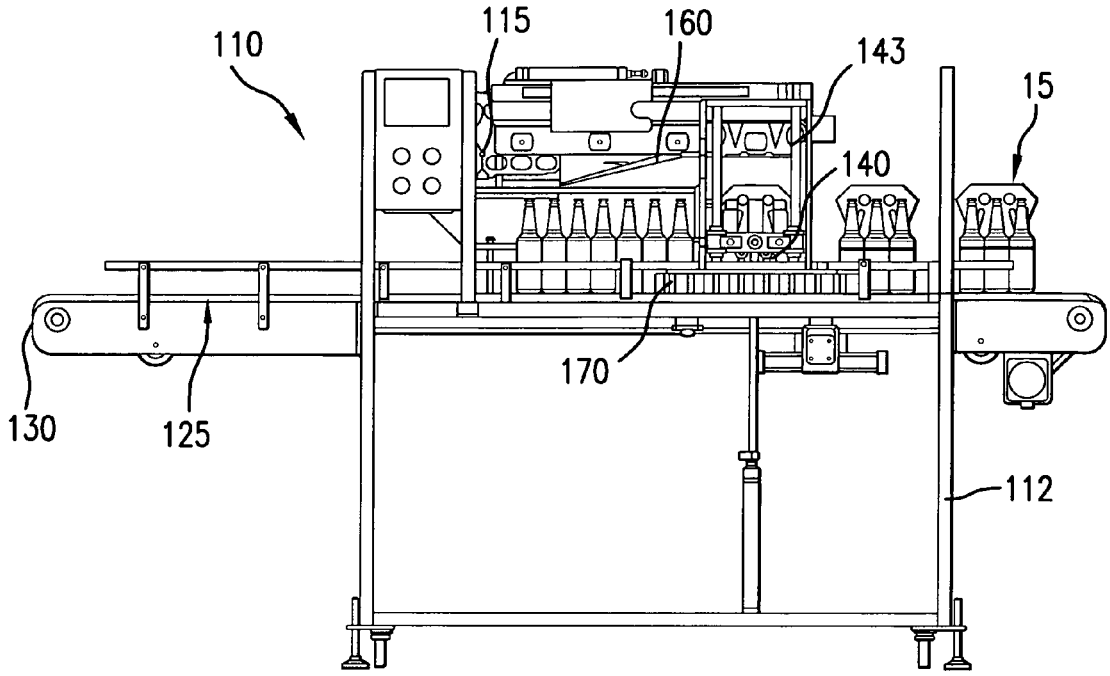
FIG. 11 is a side view of the machine shown in FIG. 7.
Figure 12:
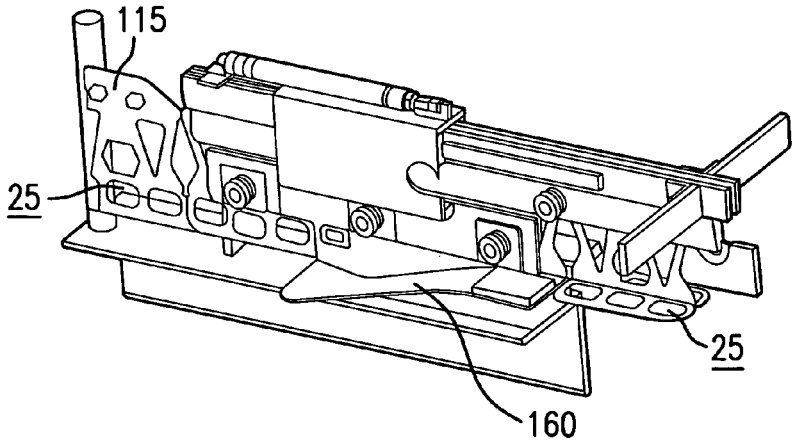
FIG. 12 is a side perspective view of carrier stock traveling through a plow according to one preferred embodiment of this invention.

According to one preferred embodiment of the invention, best shown in FIGS. 9 and 11, plow 160 is positioned between carrier unwinder 150 and jaw assembly 140. Plow 160 is preferably positioned and arranged to spread each carrier of the plurality of carriers in carrier stock 115 for placement onto jaw assembly 140. Specifically, for carrier stock 115 having a center weld, container apertures 25 are generally positioned through two layers of material. As such, plow 160 preferably separates the two layers of material to provide two preferably coplanar sets of apertures 25 for placement on containers. Such a result is best shown in FIG. 12 whereby container stock 115 enters plow 160 in a single plane and exits plow 160 configured into two planes, including a plane of material containing an array of apertures 25. Plow 160 may alternatively be used to configure carrier stock 115 into any other desirable configuration prior to placement onto or into jaw assembly 140.

One such additional configuration would apply to flexible carrier 10 as shown in FIG. 1. Such a flexible carrier 10 includes a single layer of material which is thereupon stretched over and around individual containers as shown in FIGS. 2-4.

FIGS. 2-4 show the process of application of flexible carrier 10 to containers 50. As shown in FIG. 2, prior to application, each container 50 in a column of containers 50 is spaced from each adjacent container and jaw assembly 140 engages flexible carrier 10 above a spaced plurality of containers 50. FIG. 3 shows applicating machine 110 during application of flexible carrier 10 to containers 50. As shown, each of four end straps 80 overlap a top edge of each corner container lid in the plurality of containers 50. Jaw assembly 140 is then urged downward to engage flexible carrier 10 with the plurality of containers 50 as shown in FIG. 4. Jaw assembly 140 then preferably released from package 15 as described in more detail herein.

As best shown in FIG. 9, jaw assembly 140 is preferably positioned with respect to infeed 130 to urge a carrier, such as flexible carrier 10, over the plurality of containers 50, preferably in a reciprocating manner. Specifically, according to this preferred embodiment, jaw assembly 140 reciprocates in an up and down motion as containers are provided beneath or within jaw assembly 140. According to one preferred embodiment of the invention, jaw assembly 140 includes a plurality of fingers 145 that engage openings, such as container apertures 25, within carrier 10 to engage carrier 10 with the plurality of containers 50.

Fingers 145 are preferably configured to grip carrier stock 115 with a pair of fingers 145 engaged through each transverse pair of container receiving apertures 25 in carrier stock 115. The circumferential spacing between adjacent fingers 145 is preferably approximately equal to a pitch of carrier, i.e., the distance between adjacent centers of container receiving openings. The lateral spacing between each pair of fingers 145 is preferably slightly less than a width between transverse pairs of container receiving apertures 25. Carrier stock 115 is engaged with fingers 145 of jaw assembly 140 immediately prior to application to containers.

As fingers 145 reciprocate within jaw assembly 140, container receiving apertures 25 within carrier stock 115 stretch to accommodate a container 50, such as shown in FIG. 2. According to one preferred embodiment of this invention, best shown in FIG. 3, immediately prior to application containers 50, end straps 80 of flexible carrier 10 are positioned over a top portion of a respective container 50 and pulled downward to expand around the respective container 50. Flexible carrier 10 in a stretched condition is positioned over a plurality of containers 50 so that each container receiving aperture 25 engages with one container 50, such as shown in FIG. 4. Upon engagement with the containers, carrier stock 15 is released from jaw assembly 40 and grips a perimeter of container, either around a chime in a rim-applied carrier (RAC) configuration or, more preferably in bottle applications, around a sidewall in a sidewall-applied carrier (SAC) configuration.

Figure 10:
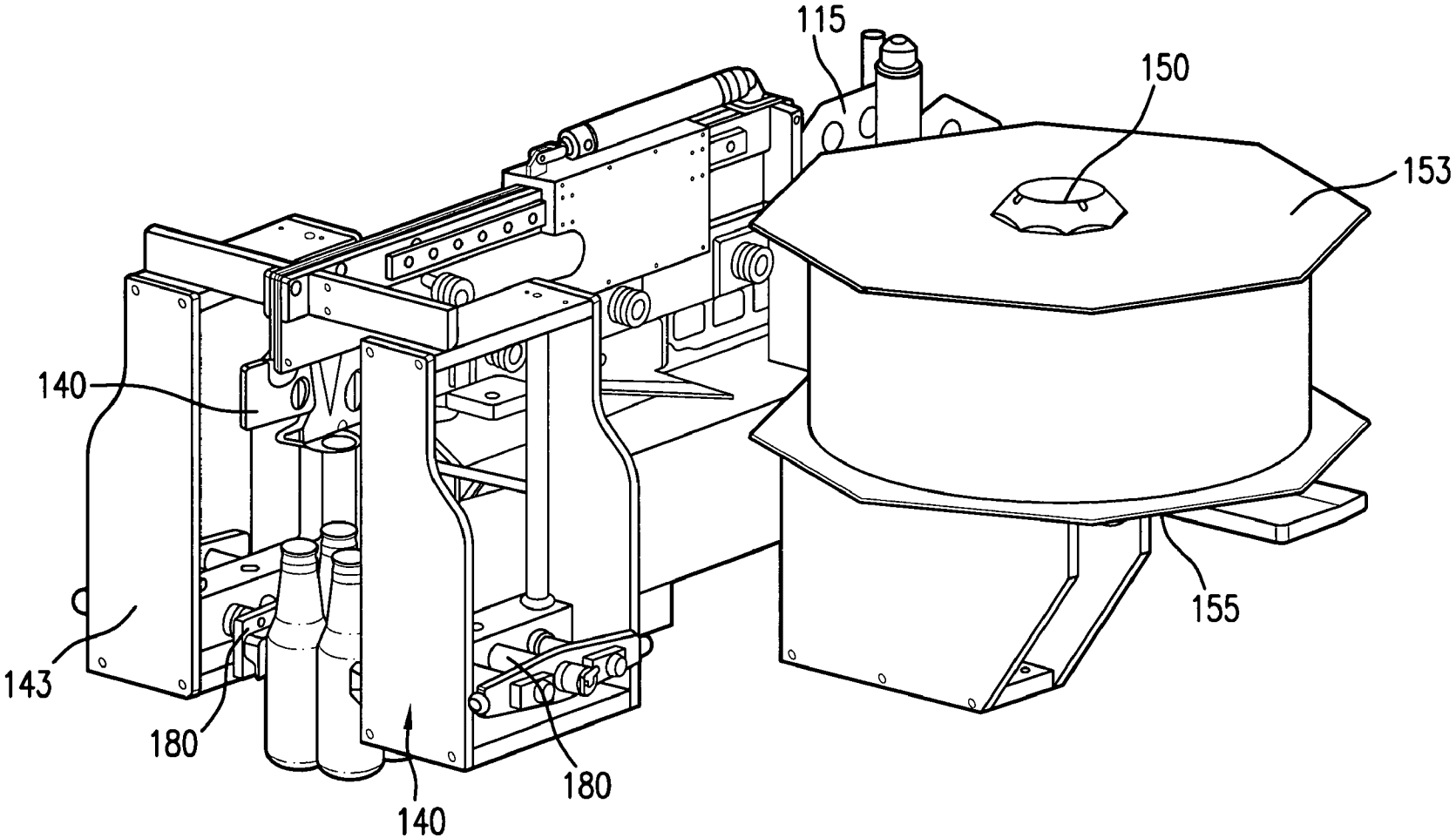
FIG. 10 is a side perspective view of an opposite side of the machine shown in FIG. 9.

Cam 143 may be connected with respect to jaw assembly 140 such as shown in FIGS. 9-11. Cam 143 is preferably configured to generally follow a profile of each container of the plurality of containers thereby permitting consistent and predictable application of carrier stock 115 over the plurality of containers 50. In addition, cam 143 may be replaceable and/or adjustable to permit application of carrier stock 115 to containers having different sizes, diameters and configurations and additionally to permit RAC or SAC packages. For instance the downward travel of jaw assembly 140 may be adjusted to permit application of carrier stock 115 around a general mid-section of container, thereby resulting in a SAC package such shown in FIG. 9.

According to one preferred embodiment of the invention, container indexer 170 is positioned inline with conveyor 125 to index a desired quantity of containers for jaw assembly 140. Container indexer 170 may include a plurality of pockets or similar device for positively capturing, containing and/or moving a desired quantity of containers. Such pockets may be formed within a pair of generally parallel sidewalls positioned on either side of the plurality of containers. Such pockets and/or sidewalls may be adjustable relative to each other to permit a variety of sizes and configurations of containers.

According to one preferred embodiment of the invention, scanner 210 may be positioned upstream of jaw assembly 140, such as between jaw assembly 140 and carrier unwinder 150. Scanner 210 is preferably used to count container receiving apertures 25 and/or other measure of length of carrier stock 115 to determine a proper length of carrier stock 115 to provide to jaw assembly 140. Scanner 210 may be used in connection with a means for drawing or unspooling an amount of carrier stock 115 until scanner 210 arrives at a predetermined length and/or count to halt the advance of additional carrier stock 115. In such a manner, multiple flexible carriers 10 may be provided simultaneously to jaw assembly 140 for application.

According to one preferred embodiment of this invention, such as shown in FIG. 10, a clamp or set of pneumatic clamps 180 is positioned with respect to jaw assembly 140 to grasp the containers as jaw assembly 140 is raised from the containers. Clamps 180 are preferably arranged and configured to minimize or eliminate any effect on containers as they are grasped for removal of jaw assembly 140. In this manner, unitized bottles remain together and inline within applicating machine 110 as jaw assembly 140 is pulled away from container stock 115 and the containers 50.

Accordingly, in a method of packaging multiple containers in unitized packages, a plurality of containers are presented to applicating machine 110 preferably to infeed 130. A generally continuous carrier stock 115 is likewise moved through applicating machine 110, generally at a similar rate as the plurality of containers. Carrier unwinder 150 is preferably integrated within applicating machine 110 to unwind the generally continuous string of carrier stock 115 through applicating machine 110.

A predetermined quantity of containers is next preferably separated from the plurality of containers, for example, a quantity of six containers. The predetermined quantity of containers may then be indexed to a position below jaw assembly 140, such as with container indexer 170 as described.

Carrier stock 115 is then presented to jaw assembly 140 which is lowered to position the carrier over the containers to form unitized package 15. Finally, according to a preferred embodiment of this invention, unitized package 15 is grasped, such as with clamp 180, jaw assembly 140 is raised to a position clear of unitized package 15 and unitized package 15 is advanced from beneath jaw assembly 140.

Following application to containers, carrier stock 115 is divided into individual carriers using a cut-off wheel, knives or similar device resulting in individually unitized packages 15 of a desired size which are then dispersed to a case packer (not shown). Alternatively, for example when using flexible carrier 10 as described above, each flexible carrier 10 is separated from carrier stock 115 along perforations 75 positioned between adjacent end straps 80 by virtue of the application process. Specifically, as each one or more flexible carriers 10 is loaded into jaw assembly 140, each flexible carrier 10 is separated from an adjacent flexible carrier 10 as a result of the engagement with jaw assembly 140. Perforations 75 as described above are preferably extend into a periphery of flexible sheet 20 so as to permit the free separation of each adjacent flexible carrier 10 from carrier stock 115.

According to a preferred embodiment of this invention, machine 110 is capable of packaging approximately sixty containers per minute or ten "six packs" per minute. This contrasts with the approximately 1500 and 1800 containers per minute possible on conventional packaging equipment, however, in lower volume operations such lower capacity may be desirable.

Figure 13:
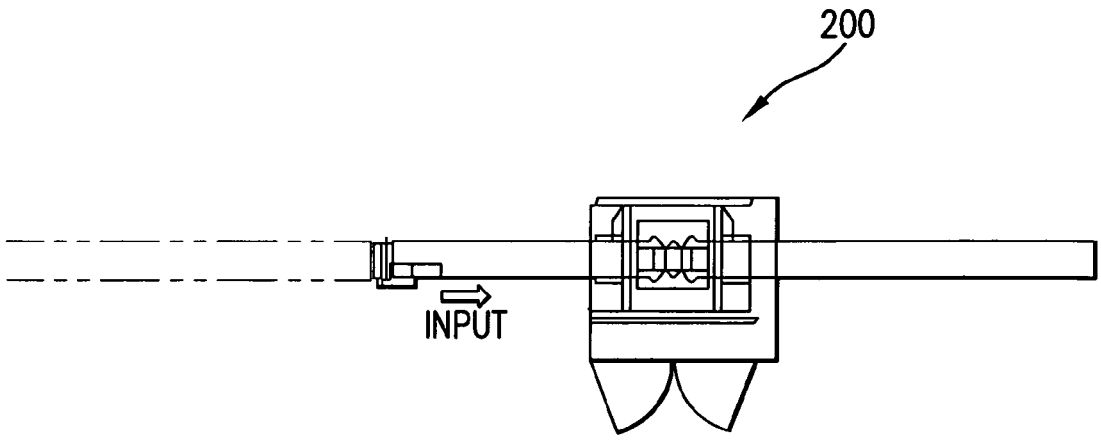
FIG. 13 is a top schematic view of sleeve applicator machine used in connection with one preferred embodiment of this invention.
Figure 14:
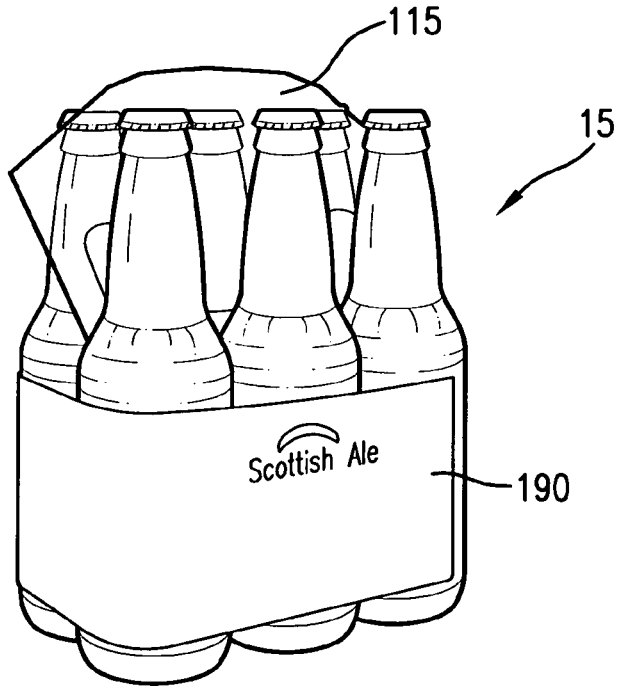
FIG. 14 is a package according to one preferred embodiment of this invention.

Additional equipment, such as sleeve applicator machine 200 shown in FIG. 13, may be used in connection with the resulting package 15. FIG. 14 shows one embodiment of package 15 including carrier and sleeve 190 or similar band around a perimeter of the unitized containers. Such a sleeve 190 may assist in providing a tighter, sturdier package while also providing additional billboard space for packaging graphics and related consumer information.

While in the foregoing specification this invention has been described in relation to certain preferred embodiments thereof, and many details have been set forth for purpose of illustration, it will be apparent to those skilled in the art that carrier 10 and the related method of manufacture are susceptible to additional embodiments and that certain of the details described herein can be varied considerably without departing from the basic principles of the invention.

The invention claimed is:

1. A method of packaging multiple containers in unitized packages, the method comprising the steps of:

providing a plurality of containers to an applicating machine;

separating a desired quantity of containers from the plurality of containers;

spacing the desired quantity of containers in at least one column;

clamping and holding the desired quantity of containers in a position;

moving a carrier through the applicating machine;

lowering a jaw assembly downwardly to position the carrier over the desired quantity of containers to form a unitized package;

raising the jaw assembly in a reciprocating motion back upwardly to a position clear of the unitized package;

releasing the desired quantity of containers;

advancing the unitized package from beneath the jaw assembly; and reciprocating the jaw assembly over another continually indexed plurality of containers.

2. The method of packaging of claim 1 further comprising the step of:

sensing a length of carrier provided to the applicating machine.

3. An applicating machine for applying a flexible carrier to a plurality of containers provided from an infeed, the applicating machine comprising:

a conveyor positioned inline with the infeed;

a plurality of spacers to space each container in a column of the plurality of containers from each adjacent container;

a container indexer positioned inline with the conveyor to index a desired quantity of containers for the jaw assembly and to permit continuous indexing of the desired quantity of containers;

a jaw assembly positioned with respect to the conveyor to move in a reciprocating up and down motion to urge the flexible carrier downwardly over the desired quantity of containers of the plurality of containers and subsequently release upwardly from a resulting package: and a set of pneumatic clamps positioned with respect to the jaw assembly to grasp and hold the desired quantity of containers as the jaw assembly is raised from the containers.

4. The applicating machine of claim 3 wherein the jaw assembly includes a plurality of fingers that engage openings within the flexible carrier to engage the flexible carrier with the plurality of containers.

5. The applicating machine of claim 3 further comprising:

a scanner positioned to count container receiving apertures of the flexible carrier.

6. An applicating machine for applying a flexible carrier to a plurality of containers, the applicating machine comprising:

a plurality of spacers to space each container in a column of the plurality of containers from each adjacent container;

a container indexer positioned inline with the conveyor to index a desired quantity of containers for the jaw assembly and to permit continuous indexing of the desired quantity of containers;

a jaw assembly positioned to move in a reciprocating up and down motion to urge the flexible carrier downwardly over the desired quantity of containers and subsequently release the flexible carrier as the jaw assembly moves upwardly from a resulting package of container;

a clamp positioned with respect to the jaw assembly to grasp the containers and hold the containers in place as the jaw assembly is raised from the containers.

7. The applicating machine of claim 6 further comprising:

a carrier unwinder providing a generally continuous string of flexible carriers to the jaw assembly.

8. The applicating machine of claim 7 further comprising:

a scanner positioned between the carrier unwinder and the jaw assembly to meter a proper length of flexible carriers to provide to the jaw assembly.

* * * * *